United States Patent [19]

Cooper et al.

[11] Patent Number: 4,644,993

[45] Date of Patent: Feb. 24, 1987

[54] MODULAR PANEL SYSTEM

[76] Inventors: John Cooper, "Sherwood", School Road, Barkham, Berkshire; Reginald E. Hall, "Perada", Marsh Lane, Taplow, Berkshire; Peter G. Lloyd-Jones, "Woodlands", Fleet Hill, Finchampstead, Berkshire, all of England

[21] Appl. No.: 708,710

[22] Filed: Mar. 6, 1985

[30] Foreign Application Priority Data

Mar. 7, 1984 [GB] United Kingdom ..... 8405915
Dec. 6, 1984 [GB] United Kingdom ..... 8430882

[51] Int. Cl.[4] ..... E06B 3/12
[52] U.S. Cl. ..... 160/229 R; 160/351
[58] Field of Search ..... 160/351, 135, 229 R; 52/272, 239, 91, 581, 586; 40/605; 16/268, 382, 373, 387

[56] References Cited

U.S. PATENT DOCUMENTS

| | | | |
|---|---|---|---|
| Re. 31,733 | 11/1984 | Haworth et al. | 160/135 |
| 2,297,629 | 9/1942 | Meyer et al. | 160/229 R |
| 2,406,729 | 8/1946 | White et al. | 160/119 |
| 4,134,564 | 1/1979 | Hanna | 160/351 |
| 4,491,166 | 1/1985 | Hanna | 160/351 |

*Primary Examiner*—Ramon S. Britts
*Assistant Examiner*—Sarah A. Lechok Eley
*Attorney, Agent, or Firm*—Lawrence Rosen

[57] ABSTRACT

A modular panel system consists of a plurality of panels. Each panel carries at least one and preferably two pivotal connection devices. Each pivotal connection device has thereon a hook-like or latch-like member which can fit into a slot to releasably connect one panel to an adjacent panel. A particular design of double axis hinge is also disclosed, which serves as the pivotal connection device.

5 Claims, 15 Drawing Figures

MODULAR PANEL SYSTEM

This invention relates to a modular panel system which is particularly useful for exhibition and conference use, whereby posters and other visual material can be displayed in an attractive manner. Such a system is also useful in dividing up space in a desired and readily altered manner. The invention also relates to a modular panel system incorporating a particularly advantageous design of hinge, used to allow adjacent panels when connected together to pivot one relative to the other.

Various designs of panel systems, some of which are folding panel systems, have been proposed. Examples include the proposals in the following patent Nos.:

G.B. 1,311,761
G.B. 1,478,515
U.S. 1,282,685
U.S. 3,356,403
U.S. 3,605,851
U.S. 3,592,289
U.S. 3,913,656
U.S. 3,987,838
U.S. 4,147,198
(Reissued No. 30,777)
G.B. 2,069,212B
G.B. 2,117,158B Some of these prior proposals are pivotally jointed or folding systems, for example U.S. Pat. Nos. 1,282,685, 3,592,289, and 4,147,198, and G.B. 2,069,212B. Though the systems are designed to fold to facilitate carrying from place to place, the fact remains that it is often very inconvenient and awkward to carry a folded panel system and it is difficult or impossible to alter the system, e.g. by omission of one panel, without disassembly and reassembly. In other words, to alter the number of panels provided by a folding panel system is usually not possible in practice for unskilled persons. On the other hand, non-folding systems have been proposed wherein individual panels are connected to support posts or the like in order to provide the desired system. Examples of this type of arrangement are the proposals in G.B. Pat. No. 1,311,761, U.S. Pat. No. 3,605,851 and U.S. Pat. No. 3,356,403. These systems are generally characterised by the use of quite complex mechanical connections and panel support arrangements, and hence tend to be expensive.

According to the present Applicant's best knowledge and belief, there remains a need for a modular panel system that is truly versatile, that is to say, provides most of the advantages of both the folding and non-folding systems referred to above, and which at the same time is simple to manufacture and relatively inexpensive.

According to one aspect of the present invention, there is provided a modular panel system consisting of a plurality of panels, each panel having at least one pivotal connection device carried thereby, in which the pivotal connection device has thereon a hook-like or latch-like member whereby a panel carrying such a device can be releasably connected to an adjacent panel.

According to another aspect of the invention, a modular panel system consists of a plurality of panels, each panel carries one or more hinges, and at least one of the hinges of the system includes first and second pin members each having parallel limbs of circular cross-section forming hinge pins, and first and second hinge plates, each of the hinge plates having first and second limb-receiving journals, the arrangement being such that one hinge plate can pivot through 360° relative to the other, the first 180° of this movement being pivoting about a first common axis defined by collinearity of two axes of pivoting, namely the axis of pivoting of the second limb of the first pin member within the first journal of the second hinge plate and the axis of pivoting of the first limb of the second pin member within the second journal of the first hinge plate, and the second 180° of the said movement being pivoting about a second common axis defined by collinearity of two axes, namely the axis of pivoting of the first limb of the first pin member within the first journal of the first hinge plate and the axis of pivoting of the second limb of the second pin member within the second journal of the second hinge plate, and in which, in each pin member, the parallel limbs are joined at their ends by cross limbs so that each pin member has a substantially rectangular configuration.

According to a third aspect of the invention, there is provided a modular panel system consisting of at least two panels in combination with a pivotal connection device which is separable from the panels, the device having a pair of hook-like or latch-like members one of which cooperates with a slotted latch plate on one panel and the other of which cooperates with a slotted latch plate on the other panel.

Reverting to the first aspect of the invention, in a preferred version, the hook-like or latch-like member is formed by a downwardly-extending tongue, e.g. of sheet metal, which is carried by and located substantially normal to a plate forming part of the pivotal connection device.

Preferably the pivotal connection device is a double-axis hinge of the kind described in the preceding paragraph but one.

According to a most advantageous but not essential feature of the invention, the hinging device or devices is or are connected to the panel in a manner which is known per se, but which yields particular benefit when employed in a modular panel system as described herein. Each panel has a frame or border constituted by a metal extrusion, e.g. aluminium, and the extrusion is of channel form. The internal surfaces of the walls of the channel (but not the base of the channel) are grooved. These grooves in use serve to receive the threads of grub screws or the like. The grub screws are employed to fix a mounting fitting in the channel. The hinging device is connected to the mounting fitting. A slot plate may be connected to or form part of another mounting fitting on another panel. The channel here referred to is outwardly opening, in contrast to the inwardly open channels which receive the edges of separate panel boards in the known design illustrated for example in FIG. 4 of G.B. Pat. No. 2,069,212B. This arrangement of outwardly opening channel, grooved walls, and mounting fittings employing grub screws or the like leads to an inexpensive and versatile design of panel and facilitates easy interconnection and disconnection of adjacent panels. The presence of the outwardly open channel also allows a simple connection fitting to be used to temporarily connect one panel to the panel immediately above it in the arrangement.

In the present specification, the term "panel" is used in its normal meaning of a member forming a distinct part of a surface; it is intended to include the combination of a frame member with a display panel or board.

Such a panel or board may comprise an integrated composite made up of a pair of boards with an intervening core, as well as a simple board or a relatively stiff sheet of material, usually rectangular.

The invention will be better understood from the following non-limiting description of examples thereof given with reference to the accompanying drawings in which.

Figure 1:
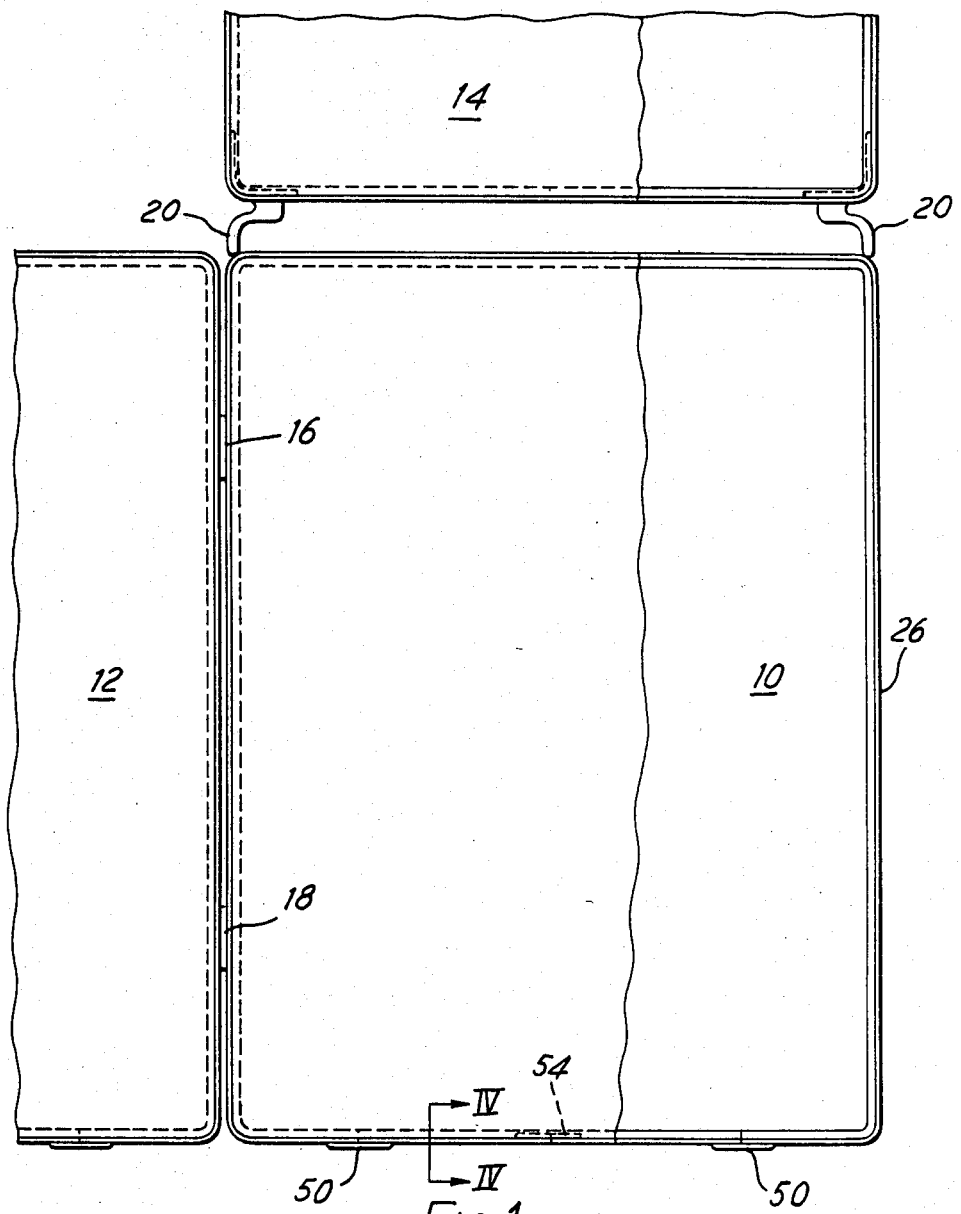
FIG. 1 is a front view of a modular panel assembly in accordance with one example of the present invention, illustrating three panels releasably connected together.

Referring firstly to FIG. 1, the modular panel assembly illustrated therein is shown as having three panels 10,12 and 14. The panels 10 and 12 are connected together by pivotal connection devices 16 and 18, which will be described in detail later, and the panel 14 is shown as just about to be releasably connected to the panel 10 below it, simple connection fittings 20 being used for this purpose in a manner which will be better understood by reference to FIG. 3. Each of the panels 10,12 and 14 is a composite integrated panel board consisting of facing sheets 22, FIG. 4, permanently glued to and integrated with a central core sheet or core member 24, which may for example be a conventional honeycomb kind of core. Such composite panel boards are used in building and can readily be purchased on the open market. As an alternative within the invention, one or more of the panels 10, 12, 14 may be made up of a front and rear board each permanently secured, e.g. by riveting or glueing, to a frame member. As yet another alternative, boards may be fixed to a frame member using VELCRO (Reg. Trade Mark) strips which interengage, one strip being glued to the frame and one to a marginal region of the panel.

The periphery of the composite panel board is surrounded by and protected by a frame member 26. A preferred form of frame member 26 is an aluminium or aluminium alloy extrusion, substantially of the cross-section illustrated in FIG. 4. As will be seen, it has a central channel 28, the internal surfaces of whose sidewalls are ribbed, grooved or serrated at 30, as seen best in FIGS. 3, 4 and 5. The purpose of these grooves is to receive the threads of a grub screw or the like which is used to attach the various parts and fittings to the frame member 26, as will be more fully described later. The extrusion also has outwardly extending flanges 32 terminated by a rounded portion 34. These serve in use to protect the edges of the composite panel board.

Figures 2, 4, 5:
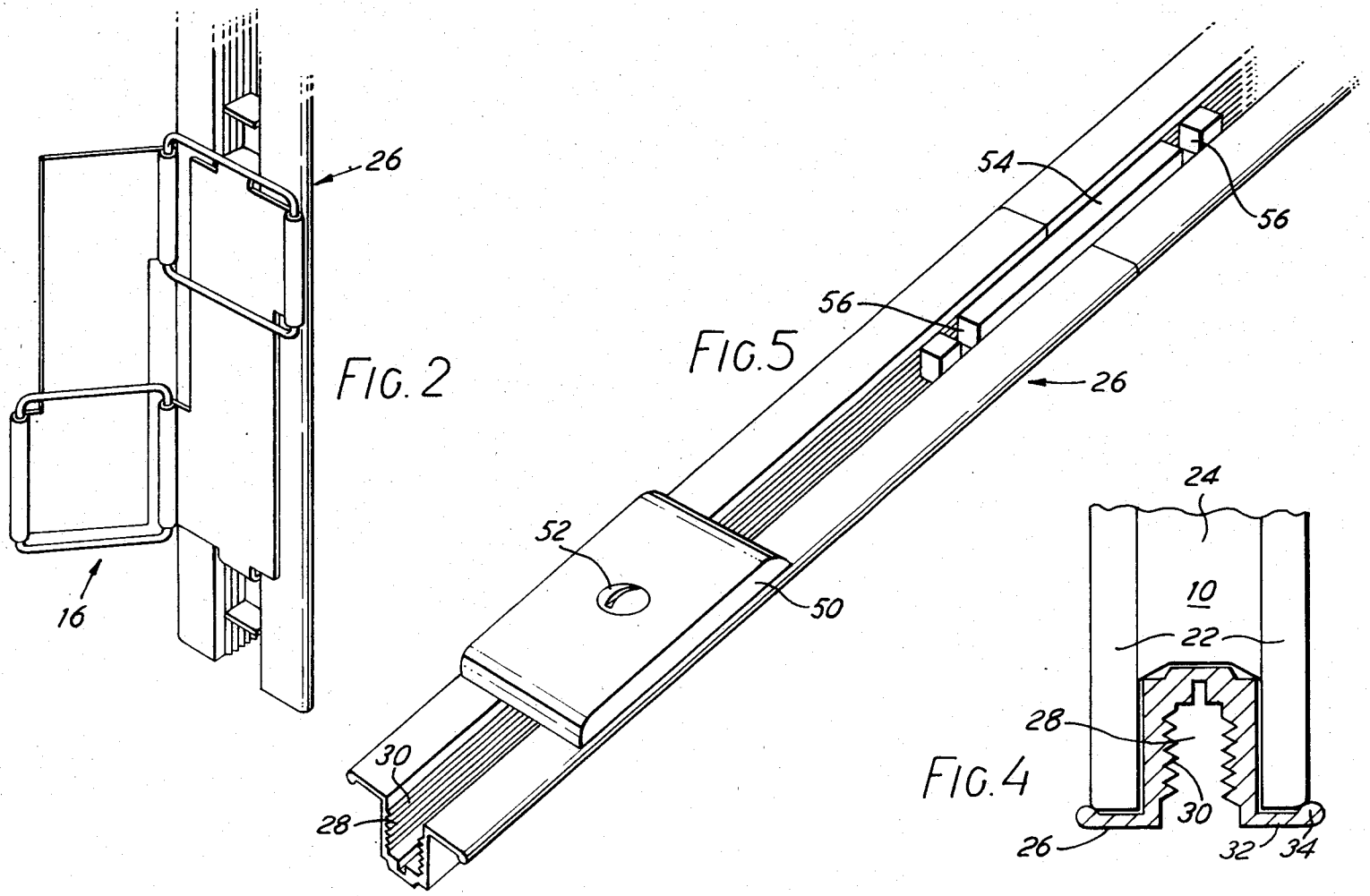
FIG. 2 is a perspective view of part of a frame member of one panel showing the attachment thereto of a pivotal connection device.
FIG. 4 is a cross-sectional view taken in a vertical plane through a horizontal portion of a panel frame member and also showing part of an integral panel which is surrounded by the frame member.
FIG 5 is a perspective view of a bottom portion of a frame member showing how it is made up by joining the two ends of one length of metal extrusion and also illustrating a foot piece connected to the frame, it will be realised that in this Figure the bottom frame portion is shown inverted compared to its normal position of use.

In FIG. 2, there is seen a perspective view of one pivotal connection device 16, which is one of the fittings which can be located partly within the channel 28. The pivotal connection device 16 will be described in more detail later with particular reference to FIGS. 6 and 9.

Figure 3:
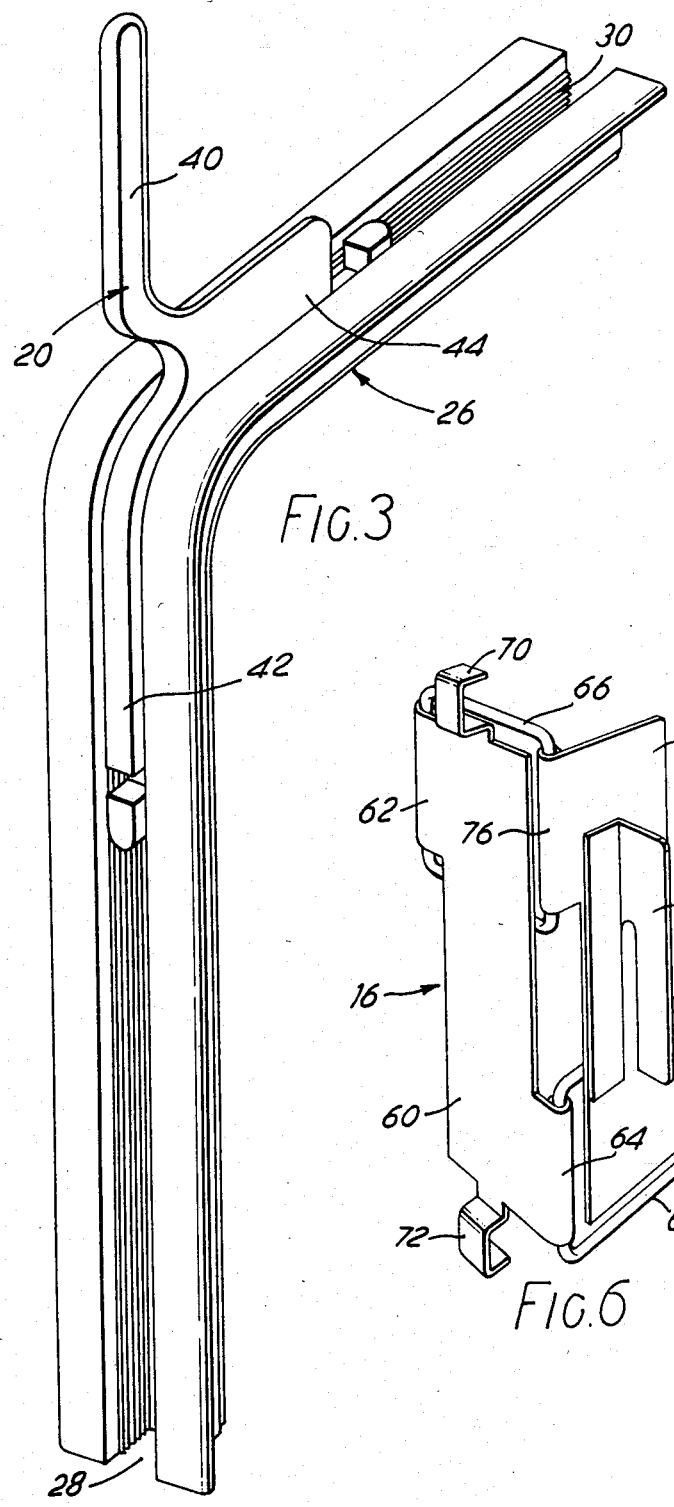
FIG. 3 is a perspective view of a corner of a frame member of a panel illustrating a simple connection fitting whereby a lower panel can be releasably connected to an upper panel.

As stated, the panels 10 and 14 are releasably connected by connection fittings 20, and a preferred embodiment of fitting 20 is illustrated in FIG. 3. It has an upper limb 40, a lower limb 42, and a central limb 44. The widths of these limbs are substantially equal and are chosen so that the limbs are a gentle manual push fit into the channels 28. The limbs 42 and 44 have recesses 46 therein for reception of a bolt or screw, whose threads, in use, engage with the grooves 30 of the channel 28 of the frame member 26. In this way the connection fitting 20 is attached to either the upper or the lower panel, and the limb 40 is then engaged in the channel of the frame member of the other panel. As seen in FIG. 1, the connection members 20 are fixed to the panel 14, and the free limbs 40 of the connection members 20, when it is desired to connect the panels, are slid into the relevant adjacent parts of the outwardly open channel 28 in the frame 26 of the panel 10.

Referring now to FIG. 5, a panel foot member 50, which may for example be of plastics or wood or other suitable material, is attached in a similar way to the frame member 26 using a screw 52 whose head is counter-sunk into the foot 50 and whose threads are arranged to engage the grooves 30 of the frame member 26. As seen in the right hand portion of FIG. 5, a simple joining bar 54 having recesses 56 is used to connect together the free ends of the frame member 26 which extends completely around the panel. It is normally convenient to position the joining bar 54 at the bottom of a panel as indicated in FIG. 1.

Figure 13:
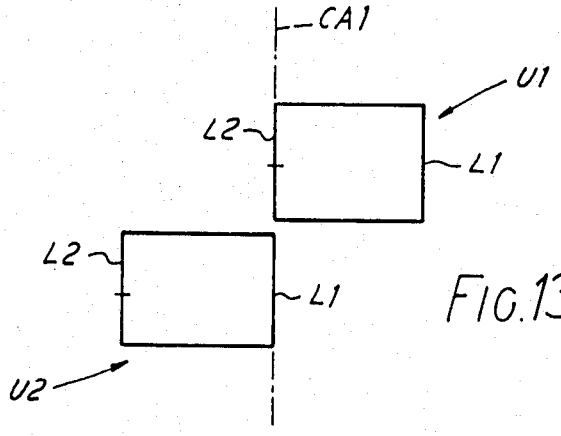
FIGS. 13–15 illustrate the principle of operation of the double-axis pivotal connection device shown in earlier figures.
Figure 14:
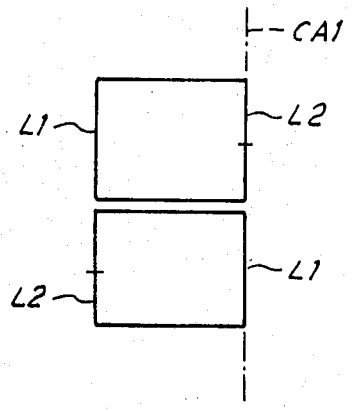
Figure 15:
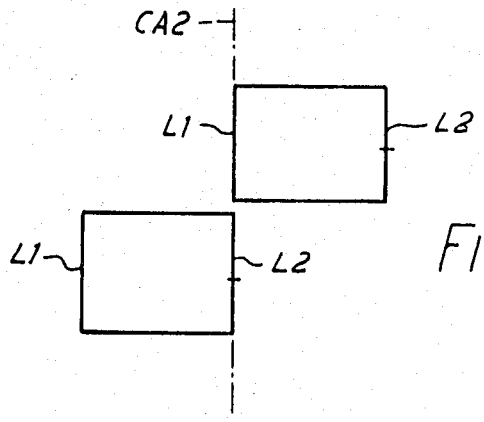

The description of the pivotal connection device 16 in detail will be better understood if reference is first made to FIGS. 13–15. FIGS. 13–15 are diagrams illustrating a double axis pivotal connection device, herein called a hinge for brevity, and showing its principle of operation; these Figures diagrammatically illustrate the two pin members used in the present illustrated hinge invention, each having a first limb and a second limb. For ease of identification, the second limbs have a short cross-shown thereon but these crosses have no physical significance. In FIG. 13 it is indicated that the first and second pin members can pivot about a common axis CA1 which is in effect defined by the collinearity of the axes of the second limb L2 of the first pin member and the first limb L1 of the second pin member. As seen in FIG. 14, the second pin member has pivoted around this axis through 180° from the position shown in FIG. 13. Thereafter, relative pivoting movement between the two pin members continues to nearly 360° in that the second pin member pivots about a second common axis CA2 which is in effect defined by the collinearity of the axes of the first limb of the first pin member and the second limb of the second pin member.

Figure 6:
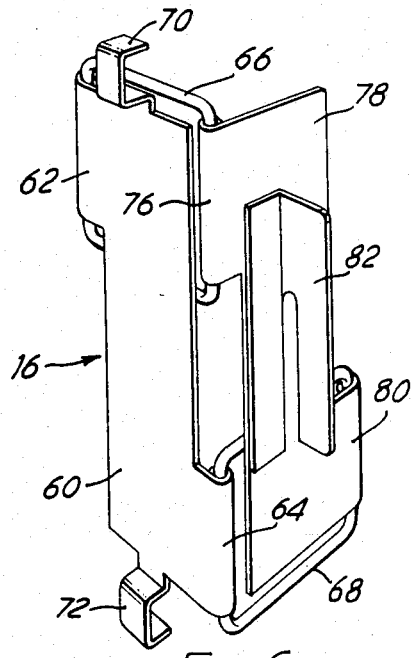
FIG. 6 is a perspective view showing more detail of a pivotal connection device.
Figure 7:
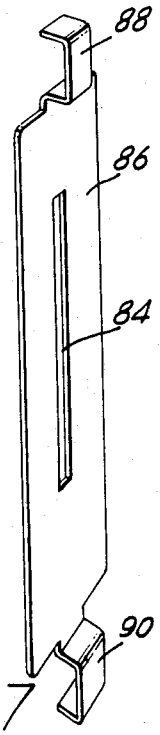
FIG. 7 is a perspective view showing a latch plate which can be used in cooperation with the pivotal connection device of FIG. 6.
Figure 8:
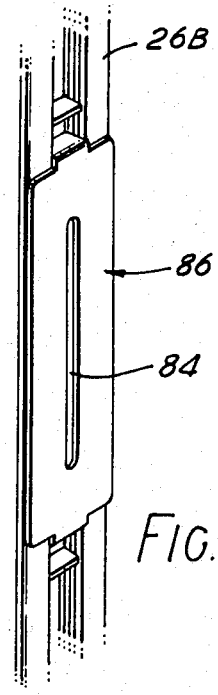
FIG. 8 illustrates the latch plate of FIG. 7 in position within a frame member.
Figure 9:
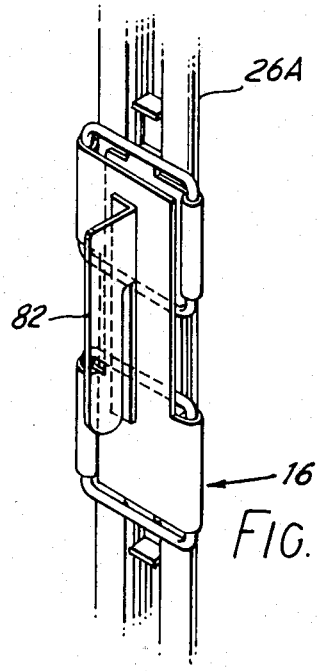
FIG. 9 is a perspective view illustrating the pivotal connection device of FIG. 6 mounted in a frame member but, like FIG. 8, not showing grub screws which may be used to secure it therein.

Referring now to FIG. 6, the pivotal connection device 16 has a first plate 60 provided with portions defining journals 62 and 64. The journal 62 receives a pin member 66 and the journal 64 receives a pin member 68. The plate 60 has attached thereto or integral therewith an upper and a lower tag, 70, 72 respectively, which define respective recesses for reception of screws. The pin member 66 has its other vertical limb mounted within a journal 76 provided within a hook-plate 78. The hook-plate 78 also provides a journal 80 to receive the second limb of the pin member 68. The hook plate 78 is integral with or has secured thereto a hook or latch member 82, which is designed to co-operate with a slot 84, FIG. 7, in a latch plate 86. The latch plate 86 has tag members 88 and 90, similar in design to the tag members 70, 72, which are intended for reception in a channel of a frame member such as channel 28 of frame member 26; moreover these tags 88, 90 define recesses for reception of the screws which lock the latch plate 86 appropriately within the channel 28. As will be readily understood, the device 16 is attached by the tags 70, 72 and screws to a frame member of one panel, and a latch plate 86 is attached in a similar manner to a frame member of an adjacent panel; in this way connection of a readily releasable nature can be simply and easily achieved, resulting in panels 10, 12 connected as at 16 and 18 in FIG. 1. Of course it will be appreciated in FIG. 1 that the structure of the pivotal connection device 18 is similar to the structure of the pivotal connection device 16 and each of them co-operates with a counterpart latch plate which may be of the form illustrated in FIG. 7. Reference to FIGS. 8 and 9 will give the reader a visual impression of how the frame members of two adjacent panels would appear, when the pivotal connection member 16 is disposed within an outwardly opening channel of a frame member 26A and when the latch plate 86 is disposed within a like channel of a frame member 26B of an adjacent panel. In use, two panels can readily be releasably connected merely by lifting the panel whose edge region is shown in FIG. 9, inserting the latch or hook 82 in the slot 84, and then gently lowering the panel to which the device 16 is connected. Disassembly is readily achieved by a reverse operation and it is not believed that a detailed description is necessary; one of the advantages of the present invention being its simplicity.

Hitherto, a modular system has been described in which one panel is provided with pivotal connection devices on one of its vertical sides and with latch plates on its opposite vertical side. In most practical embodiments, each panel will have two pivotal connection devices and two latch plates. This is not, however, essential, and in some circumstances it may be sufficient to have a single pivotal connection device on one side and a single latch plate on the other side. When one is building an assembly of panels two or three panels high, the second and third rows are connected to horizontally adjacent panels in a similar way to that already described. The panels of the upper row are connected to the panels of a lower row using the simple connector fittings shown in FIGS. 1 and 3, yielding a readily assembled and readily disassembled modular panel system.

Figure 10:
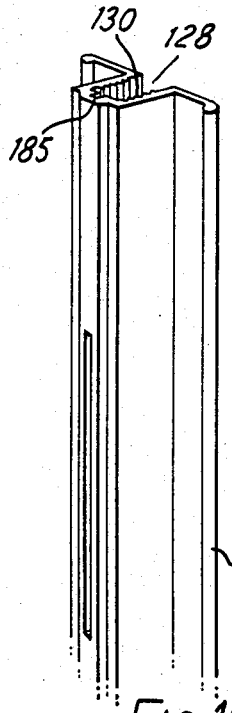
FIG. 10 illustrates an alternative embodiment of the invention in which the frame member itself is slotted to receive a hook of a pivotal connection device.
Figure 11:
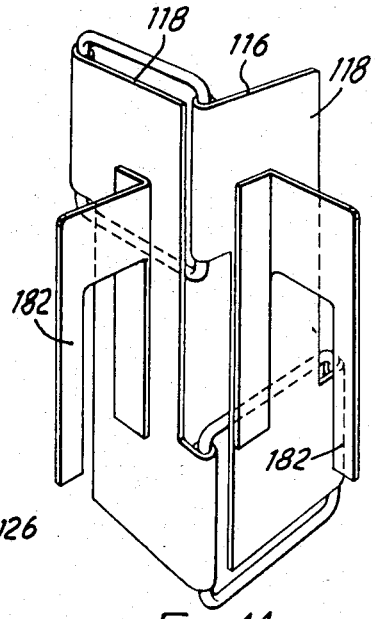
FIG. 11 illustrates an alternative form of pivotal panel connection device having two hooks, each of which is intended to engage with a frame member of each of two adjacent panels.
Figure 12:
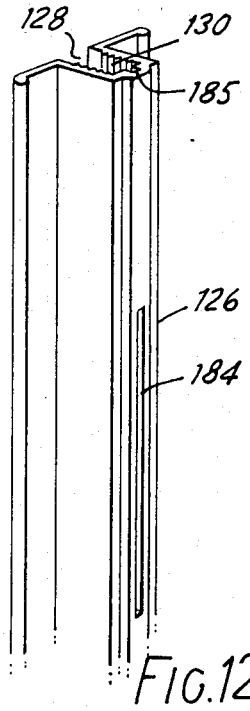
FIG. 12 illustrates another frame member similar to that of FIG. 10.

It is of course not essential to the invention that one panel should be provided with both latch plates and pivotal connection devices. In an alternative embodiment of the invention, and according to the third aspect of the invention referred to above a separate pivotal connection device as illustrated in FIG. 11 may be provided, designated to co-operate directly with slots in frame members of adjacent panels. FIGS. 10–12 illustrate this possibility, FIG. 10 showing one frame member 126 having an outwardly opening channel 128 with grooves 130 in its interior walls, FIG. 12 showing a like frame member of an adjacent panel. For clarity of illustration of the frame members, the composite board portion of the panel is not illustrated. The pivotal connection device 116 as shown in FIG. 11 has a pair of latch plates 118, and each of these carries a hook or latch member 182. Each of the frame members 126 has a slot 184 of limited length cut completely through the base wall 185 of the channel 128. It will be understood that the composite panel board is relieved or recessed as may be needed in the region of each slot 184 so as to allow space for the hook or latch 182 to pass through the slot 184 and take up its locking position when the pivotal connection fitting 116 is lowered relative to the two adjacent panels. No such recessing would be needed in the case of a panel assembly made up of two boards fixed to a frame member by glueing or by VELCRO (Reg. Trade Mark) strips. With an arrangement according to this aspect of the invention, panels need not be provided with pivotal connection members but need only have through slots at appropriate positions in the bases of the channel portions of the frame member extrusions.

As will be appreciated from the description of FIGS. 13–15, two panels connected by pivotal connection devices according to FIG. 11, or by pivotal connection devices 16, can be rotated so that one moves relative to the other through almost 360°; moreover, in contrast to all prior modular panel assembly designs of which the present Applicants are aware, such panels can not only be rotated almost through 360° but also can be readily connected together and disconnected by unskilled personnel, by virtue of the simple hook and slot connection described.

It will be appreciated that a double axis pivotal connection device or hinge has been proposed previously, see for example British Pat. No. 344,895. However, the hinge shown in the British Patent is liable to distortion of its U-shaped pins, and when two or more such hinges are employed, they are liable to bind. It is an advantage of the double axis hinge disclosed herein that the substantially rectangular formation of each of the first and second pin members gives a strong and durable structure and one which is not readily bent, thereby leading to greater reliability of the modular panel system in use. On the other hand, the invention is not to be regarded as limited to this particular design of pivotal connection device, as any pivotal connection device which allows double axis hinging in conjunction with a hooking or latching engagement could be employed.

The modular nature of the panel system disclosed is of advantage in that all the panels may be identical, and they may readily be assembled together in a wide variety of different configurations, for example, 2 rows of 4 panels one row above the other; 3 rows of panels, 5 in the bottom row, 3 in the middle row and one on the top row; a simple rectangular 4-panel arrangement; etc. etc. In addition, in any one of the these arrangements, panels may be disposed at angles other than 90° or 180° to each other because of the presence of the pivotal connection devices, and yet the modular assembly can be altered without difficulty by removing or adding one or more panels.

We claim:

1. A modular panel system, comprising a plurality of panels, each panel having one or more hinges, and at least one of the hinges of the system including first and second pin members, each having parallel limbs of circular cross-section forming hinge pins, and first and second hinge plates, each of the hinge plates having first and second limb-receiving journals offset and noncollinear with respect to each other for rotatably receiving the first and second pin members, respectively, at least one of the hinge plates of each hinge having a hook-like member thereon whereby said hinge can be releasably connected to an adjacent panel, such that one hinge plate can pivot through 360° relative to the other, the first 180° of this movement being pivoting about a first common axis defined by collinearity of the axis of pivoting of the second limb of the first pin member within the first journal of the second hinge plate and the axis of pivoting of the first limb of the second pin member within the second journal of the first hinge plate, and the second 180° of the said movement being pivoting about a second common axis defined by collinearity of the axis of pivoting of the first limb of the first pin member within the first journal of the first hinge plate and the axis of pivoting of the second limb of the second pin member within the second journal of the second hinge plate.

2. A modular panel system according to claim 1 in which each hinge plate of at least said one hinge has a hook-like member one of which cooperates with a slotted latch plate on one of the panels and the other of which cooperates with a slotted latch plate on another of the panels in order to temporarily connect the two panels for relative pivotal movement.

3. A modular panel system according to claim 1 in which each panel has a frame comprising an extruded metal strip, the strip having a cross-section defining a channel, the internal walls of the channel being grooved to cooperate with the thread of a bolt disposed to secure a hinge to the panel.

4. A modular panel system according to claim 3 in which the metal strip forms the periphery of a square or rectangular panel and further including a joining bar located in the channel portions of the two abutting ends of the strip to connect the ends to one another.

5. A modular panel system according to claim 1 wherein each hinge is separable from a panel associated therewith and further includes a hook-like member which cooperates with a slotted latch plate on the panel and each hinge plate has tags defining recesses for the reception of bolts, and wherein each panel has a frame comprising an extruded metal strip, the strip having a cross-section defining a channel, the internal walls of the channel being grooved to cooperate with the threads of the bolts disposed to secure the hinge to the channel.

* * * * *